US010641194B2

(12) United States Patent
Koo

(10) Patent No.: US 10,641,194 B2
(45) Date of Patent: May 5, 2020

(54) METHOD OF IMPROVING ENGINE STARTABILITY USING HARDWARE WAKE-UP PERIOD CONTROL AND VEHICLE USING THE SAME

(71) Applicants: Hyundai Motor Company, Seoul (KR); Kia Motors Corporation, Seoul (KR)

(72) Inventor: Bon-Chang Koo, Seongnam-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 301 days.

(21) Appl. No.: 15/724,021

(22) Filed: Oct. 3, 2017

(65) Prior Publication Data

US 2018/0163655 A1 Jun. 14, 2018

(30) Foreign Application Priority Data

Dec. 12, 2016 (KR) ..... 10-2016-0168656

(51) Int. Cl.

| | |
|---|---|
| ***F02D 41/06*** | (2006.01) |
| ***F02D 41/38*** | (2006.01) |
| ***F02D 41/04*** | (2006.01) |
| ***F02D 41/30*** | (2006.01) |
| ***F02D 41/26*** | (2006.01) |

(52) U.S. Cl.

CPC ..... *F02D 41/064* (2013.01); *F02D 41/042* (2013.01); *F02D 41/065* (2013.01); *F02D 41/3854* (2013.01); *F02D 41/26* (2013.01); *F02D 41/3082* (2013.01); *F02D 2200/021* (2013.01); *F02D 2200/023* (2013.01)

(58) Field of Classification Search

CPC .... F02D 41/061; F02D 41/064; F02D 41/065; F02D 41/3082; F02D 2250/02

See application file for complete search history.

(56) References Cited

U.S. PATENT DOCUMENTS

| | | | | |
|---|---|---|---|---|
| 2002/0002965 | A1* | 1/2002 | Majkowski | F02D 41/065 123/478 |
| 2003/0041838 | A1* | 3/2003 | Tsuchiya | F02B 17/005 123/299 |
| 2009/0216425 | A1* | 8/2009 | Hay | F02D 41/065 701/103 |

FOREIGN PATENT DOCUMENTS

| | | | |
|---|---|---|---|
| JP | 2009-002262 | A | 1/2009 |
| JP | 2011-208560 | A | 10/2011 |
| KR | 10-2005-0032147 | A | 4/2005 |

(Continued)

*Primary Examiner* — Sizo B Vilakazi
*Assistant Examiner* — Anthony L Bacon
(74) *Attorney, Agent, or Firm* — Morgan, Lewis & Bockius LLP

(57) ABSTRACT

Disclosed herein is a vehicle having improved engine startability using hardware wake-up period control by performing a vehicle state detection mode to which a battery voltage, an engine oil temperature, and an engine coolant temperature are applied by a controller in a key-off state of an engine, a wake-up fuel pressure control mode for determining whether a soaking time reaches a wake-up set time by the count of a key-off timer for 80 minutes, a pump operation control mode for operating a low-pressure fuel pump for approximately 1 second by the current supplied in response to a key-off output signal over the period of 80 minutes, and a wake-up repetition control mode for repeating a number of times the low-pressure fuel pump is operated to maximum 6 times.

19 Claims, 6 Drawing Sheets

(56) References Cited

FOREIGN PATENT DOCUMENTS

| | | | | |
|---|---|---|---|---|
| KR | 10-2012-0045279 | A | | 5/2012 |
| KR | 2012 0045279 | | * | 5/2012 |
| KR | 10-1316475 | B1 | | 10/2013 |
| KR | 10-2014-0047183 | A | | 4/2014 |

* cited by examiner

METHOD OF IMPROVING ENGINE STARTABILITY USING HARDWARE WAKE-UP PERIOD CONTROL AND VEHICLE USING THE SAME

CROSS-REFERENCE(S) TO RELATED APPLICATIONS

The present application claims priority to Korean Patent Application No. 10-2016-0168656, filed on Dec. 12, 2016, the entire contents of which is incorporated herein for all purposes by this reference.

BACKGROUND OF THE INVENTION

Field of the Invention

Exemplary embodiments of the present invention relate to engine startability of vehicles, and, particularly, to a method of improving engine startability, in which a low-pressure fuel pump is periodically activated depending on the wake-up period of an ECU (Electronic Control Unit) (a controller or an ECU) in an ignition key-off state, and a vehicle using the same.

Description of Related Art

Bubbles generated in the fuel supplied to an engine are generally a main cause of the deterioration of engine startability, and hence must be removed.

Such deterioration of engine startability may be more sensitive in a GDI (Gasoline Direct Injection) engine vehicle, an LPI (Liquefied Petroleum Injection) engine vehicle, and a diesel engine vehicle, which supply fuel to high-pressure and low-pressure pumps.

In particular, the GDI engine vehicle is supplied with gasoline at a high pressure of 250 bar for improvement in fuel efficiency and performance, which necessarily leads to generation of bubbles when the vehicle travels at a high speed and then stops.

For example, after the pressure in a fuel line is increased by the high-temperature thermal expansion therein, leakage occurs due to the movement of fuel to the injector and a regulator. In the present case where the fuel system of a GDI engine vehicle is in a high-temperature and high-pressure hot soaking state when the vehicle travels at a high speed and the ignition key thereof is turned off, the fuel system is changed from a hot soaking state to a cool down state. Subsequently, when the fuel system is in the cool down state, the pressure (i.e. the residual pressure) in the fuel line is decreased by the low-temperature contraction therein while fuel moved to the check valve of a pump is drawn, so that the residual pressure is 0 bar. For the present case, when the GDI engine restarts it is necessary to delay the time required to reach a low or high target pressure from a residual pressure of 0 bar in the fuel system, which may lead to an ignition delay.

Particularly, startability (or restartability) may be further deteriorated due to an ignition delay when the vehicle is stopped for a long time (e.g. one day) after the vehicle travels at a high speed and the ignition key thereof is then turned off.

Therefore, the GDI engine vehicle, the LPI engine vehicle, and the diesel engine vehicle adopt a hardware-based engine startability improvement logic (or an engine startability improvement mode) to improve restartability.

For example, the hardware-based engine startability improvement logic (or the engine startability improvement mode) is a method in which a door switch or a remote controller key is connected to an ECU (Electronic Control Unit) (e.g. an ECU) through an interface or a gateway so that a low-pressure pump is operated in response to a door open signal or a remote controller key operation signal which is recognized before an ignition key is turned on by a driver.

As a result, the restartability of the GDI engine vehicle, the LPI engine vehicle, and the diesel engine vehicle is improved.

However, the hardware-based engine startability improvement logic (or the engine startability improvement mode) is based on the premise that separate hardware is added thereto and extra pins for signal recognition are added to the ECU.

For the present reason, the hardware-based engine startability improvement logic (or the engine startability improvement mode) may cause an increase in cost and deterioration of the degree of freedom of layout in an engine compartment due to the addition of separate hardware.

Particularly, when a large amount of gas fuel is in the fuel line, as in the case where the vehicle travels under a high load and then the ignition key thereof is turned off, it is difficult to improve an ignition delay due to the extended time taken to form low pressure even when the low-pressure pump is operated in the hardware-based engine startability improvement logic (or the engine startability improvement mode).

The information disclosed in this Background of the Invention section is only for enhancement of understanding of then general background of the invention and should not be taken as an acknowledgement or any form of suggestion that this information forms the prior art already known to a person skilled in the art.

BRIEF SUMMARY

Various aspects of the present invention are directed to providing a method of improving engine startability using hardware wake-up period control, in which a low-pressure fuel pump is operated by activation of a controller at an engine soaking time period based on a key-off timer in an engine key-off (an ignition key-off) state, to prevent a change of fuel from liquid phase to gas phase when an engine is driven under a high load and then the ignition key thereof is turned off while resolving restriction due to the addition of separate hardware, and a vehicle using the same. Particularly, the present invention may also prevent deactivation due to discharge of a battery by applying an SOC (State Of Charge) of the battery to a condition of operation of the low-pressure fuel pump.

Other aspects and advantages of the present invention may be understood by the following description, and become apparent with reference to the embodiments of the present invention. Also, it is obvious to those skilled in the art to which the present invention pertains that the aspects and advantages of the present invention can be realized by the means as claimed and combinations thereof.

In accordance with an exemplary embodiment of the present invention, a method of improving engine startability includes (A) performing a vehicle state detection mode in which a battery voltage detection value, an engine oil temperature detection value, and an engine coolant temperature detection value are read by a controller in a key-off state of an engine, a soaking time is stored, and a count of a key-off timer is initiated, (B) performing a wake-up fuel pressure control mode when each of the battery voltage detection value, the engine oil temperature detection value, and the engine coolant temperature detection value satisfies a set condition, and whether the soaking time reaches a wake-up set time is determined by the count of the key-off timer, (C) performing a pump operation control mode in which the key-off output is transmitted in response to a signal of the key-off timer when the soaking time reaches the wake-up set time, and after a low-pressure fuel pump is operated by a current supplied thereto for a time at which the key-off output is maintained the operation of the low-pressure fuel pump is stopped by cut-off of the key-off output, and (D) performing a wake-up repetition control mode in which the number of times the low-pressure fuel pump is operated is counted as 1, and after the operation and stop of the low-pressure fuel pump are repeated until the number of times the low-pressure fuel pump is operated is counted as 6, the count of the key-off timer is stopped.

Performing the wake-up fuel pressure control mode may include (b-1) determining whether the voltage detection value satisfies a set voltage value condition, (b-2) determining whether the oil temperature detection value satisfies a set oil temperature value condition when the voltage detection value satisfies the set voltage value, (b-3) determining whether the coolant temperature detection value satisfies a set coolant temperature value condition when the oil temperature detection value satisfies the set oil temperature value, and (b-4) determining whether the soaking time reaches the wake-up set time.

When each of the voltage detection value, the oil temperature detection value, and the coolant temperature detection value does not satisfy the set condition, the time count of the key-off timer may be stopped.

Performing the pump operation control mode may include (c-1) stopping a procedure for failure diagnosis of hardware unrelated to the operation control of the low-pressure fuel pump, (c-1-1) detecting the low-pressure rail pressure and a high-pressure rail pressure values formed by residual fuel in the fuel line for supplying fuel to the engine after the key-off, (c-2) determining and outputting a target pressure of the residual fuel under the low-pressure rail pressure and the high-pressure rail pressure, (c-3) detecting the high-pressure rail pressure formed by the residual fuel and determining whether the detected high-pressure rail pressure value satisfies a set pressure value, (c-3-1) initializing communication with hardware related to the operation control of the low-pressure fuel pump, (c-3-3) supplying battery current to the low-pressure fuel pump, and (c-4) operating the low-pressure fuel pump in response to the signal of the key-off output and stopping the operation of the low-pressure fuel pump by cut-off of the key-off output.

The target pressure may be the pressure for maintaining the residual fuel in a liquid-phase state to prevent the fuel from changing from a liquid to gas phase. When the detected pressure value is greater than the set pressure value the time count of the key-off timer may be stopped.

Performing the wake-up repetition control mode may include (d-1) storing the number of times the low-pressure fuel pump is operated as one wake-up NO, (d-2) determining whether to continuously perform the count of the key-off timer when a low-pressure pump pressure detection value and the battery voltage detection value satisfy a wake-up stop condition, (d-2-1) stopping the count of the key-off timer in a key-on state of the engine, and (d-3) stopping the count of the key-off timer when the wake-up NO is counted as 6 by the repeated operation and stop of the low-pressure fuel pump.

The wake-up stop condition may be determined by a relationship between the low-pressure pump pressure detection value and a set low-pressure pump pressure value and a relationship between the battery voltage detection value and a set battery voltage value. The wake-up stop condition may be satisfied when the low-pressure pump pressure detection value is greater than the set low-pressure pump pressure value, and when the battery voltage detection value is greater than the set battery voltage value. When the low-pressure pump pressure detection value is less than the set low-pressure pump pressure value, the soaking time may be updated and the count of the key-off timer is initiated again. When the battery voltage detection value is less than the set battery voltage value, the count of the key-off timer may be stopped.

In accordance with another exemplary embodiment of the present invention, a vehicle includes an ECU including a wake-up determination device configured to generate a determination condition satisfaction signal for operating a low-pressure fuel pump based on the ignition key state, engine oil temperature, and engine coolant temperature after key-off of an engine; a key-off operation device configured to generate an operation signal for operating the low-pressure fuel pump at a period of 80 minutes when the operation condition of the low-pressure fuel pump occurs; and a switching output device configured to output a key-off output signal to the low-pressure fuel pump for a time of 1 second according to the operation signal, and the low-pressure fuel pump operated by control of the ECU.

The low-pressure fuel pump may be disposed in a fuel tank for storing fuel, the fuel tank may be disposed with a high-pressure fuel pump, and the fuel tank, the low-pressure fuel pump, and the high-pressure fuel pump may constitute a fuel system together with a common rail for supplying the fuel, and an injector for injecting the fuel into an engine combustor.

The methods and apparatuses of the present invention have other features and advantages which will be apparent from or are set forth in more detail in the accompanying drawings, which are incorporated herein, and the following Detailed Description, which together server to explain certain principles of the present invention.

Figure 1:
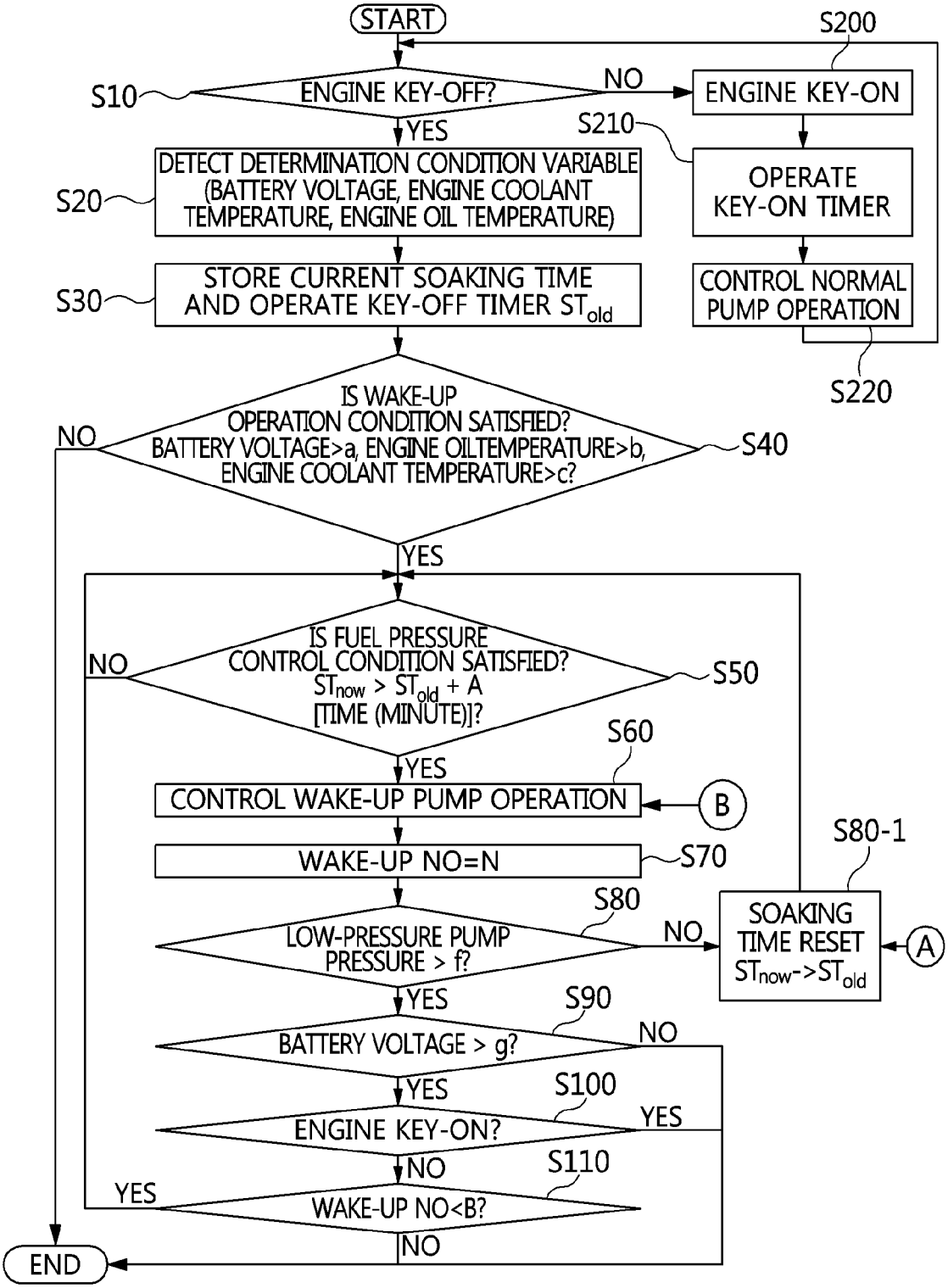
FIG. 1 is a flowchart illustrating a method of improving engine startability using hardware wake-up period control according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention through the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
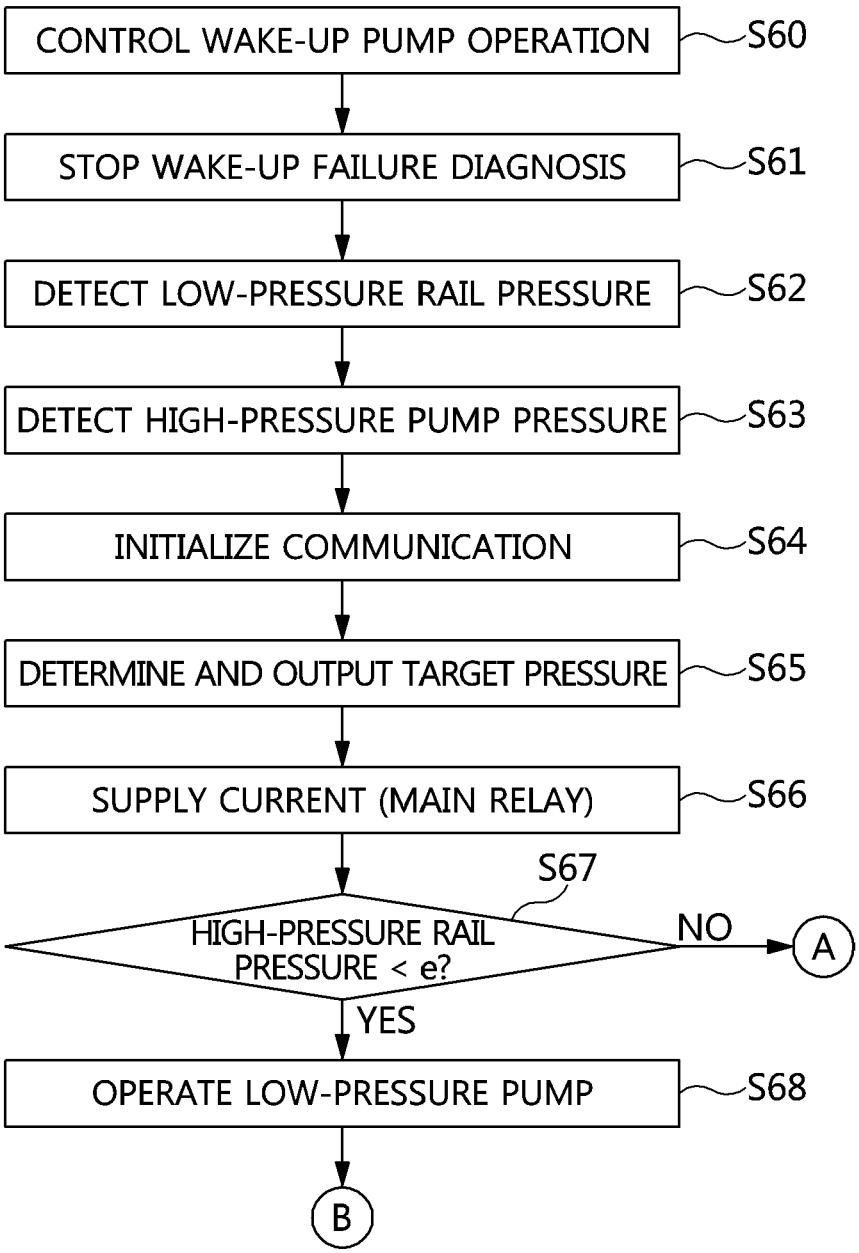
FIG. 2 is a flowchart illustrating a method of controlling wake-up pump operation according to an exemplary embodiment of the present invention.

Referring to FIG. 1 and FIG. 2, a method of improving engine startability is configured to determine a wake-up condition based on a battery voltage, an engine oil temperature, and an engine coolant temperature (S40), and then controls the operation of a wake-up pump (S60) when a fuel pressure control condition is satisfied for a soaking time (S50), thereby preventing the fuel from changing from a liquid phase to gas phase due to the rapid pressure deterioration of residual fuel in a fuel line by periodically operating a low-pressure pump using hardware wake-up period controlled by an ECU (Electronic Control Unit) in a state in which a vehicle travels under a high-load condition (e.g. at a high speed of approximately 100 km/h or more) and the ignition key thereof is then turned off.

As a result, the method resolves a phenomenon which occurs when a vehicle travels under a high-load condition and the ignition key thereof is then turned off, the residual fuel in the fuel line is changed from a liquid phase to gas phase, as observed through Boyle's law, while the pressure of the residual fuel is dropped slowly after a certain time period after the key-off. In addition, the method resolves a phenomenon in which when a large amount of gas fuel is in the fuel line, an ignition delay occurs due to the extended time required to form low pressure even through the low-pressure pump is operated. Moreover, the method may maintain constant pressure in the fuel line by controlling fuel pressure after the key-off, and particularly improve the ignition delay due to soaking for approximately one day or more by preventing bubbles from being generated in the residual fuel when the vehicle travels at a high speed and the ignition key thereof is then turned off.

Figure 3:
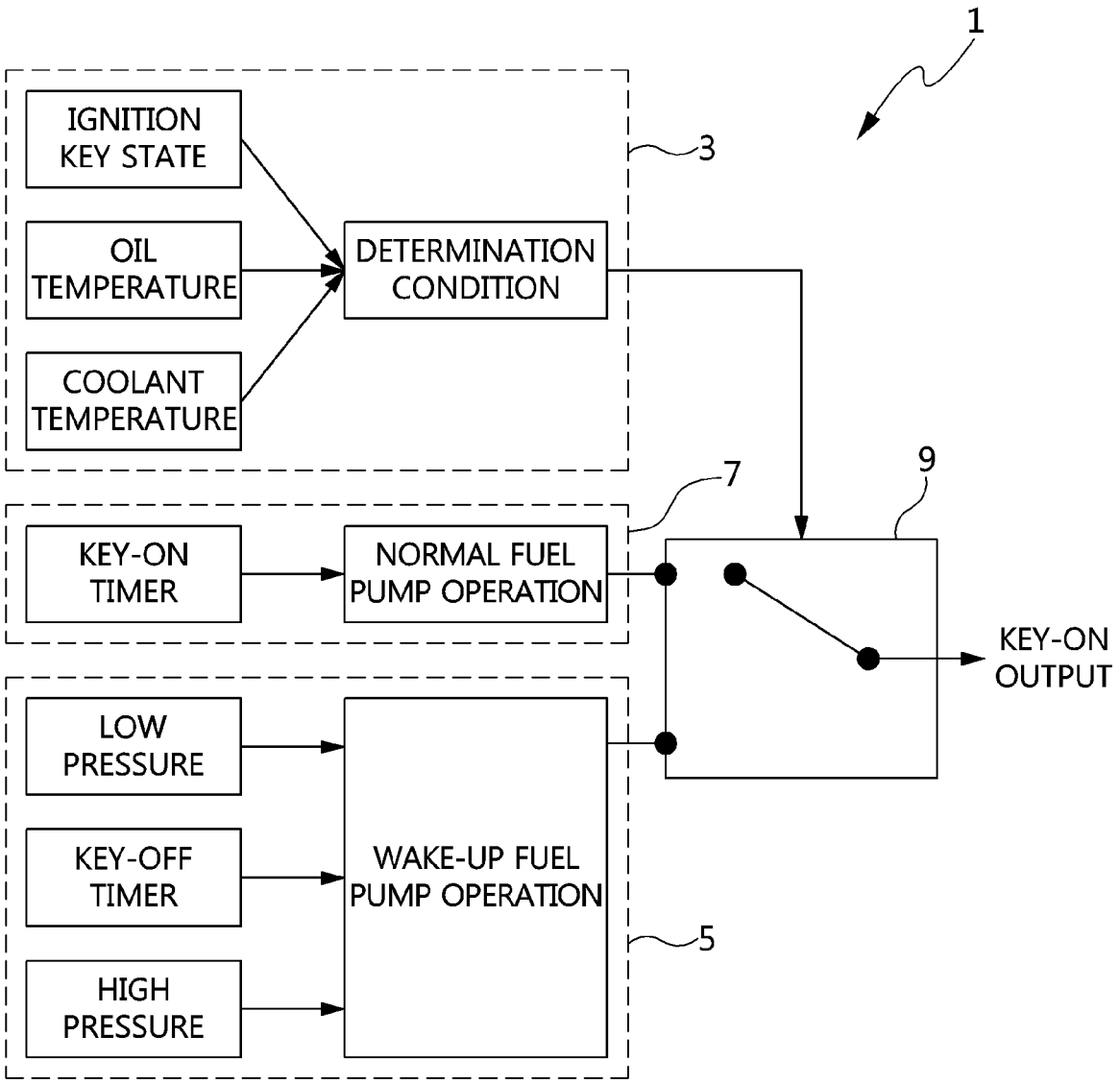
FIG. 3 is a block diagram of a controller configured to improve engine startability using hardware wake-up period control according to an exemplary embodiment of the present invention.

FIG. 3 illustrates an example in which a controller 1 is configured to improve engine startability by controlling the operation of a low-pressure pump using a wake-up period which includes a wake-up determination device 3, a key-off operation device 5, a key-on operation device 7, and a switching output device 9.

As illustrated in FIG. 3, the wake-up determination device 3 is configured to determine whether a wake-up condition is satisfied based on an ignition key state, an engine oil temperature, and an engine coolant temperature, which are provided as input data. The key-off operation device 5 is configured to operate a fuel pump (a low-pressure pump and/or a high-pressure pump) in response to the low and high pressures of fuel and the signal of a key-off timer, which are provided as input data, in the state in which the ignition key of the vehicle is turned off and an engine is stopped. Since the operation of the fuel pump is controlled in a pump control manner by the key-off timer in the specific condition of the vehicle (e.g. the condition in which the vehicle travels under a high load and the ignition key thereof is turned off and the condition in which the engine is stopped for one day or more), is referred to as a wake-up fuel pump operation control mode. The key-on operation device 7 is configured to operate the fuel pump (the low-pressure pump and or the high-pressure pump) in response to the signal of a key-on timer, which is provided as input data, in the state in which the ignition key of the vehicle is turned on and the engine is driven. Since the operation of the fuel pump is controlled in a typical pump control manner by the key-on timer in the vehicle, it is referred to as a normal fuel pump operation control mode. The switching output device 9 is configured to act as a main relay. The switching output device 9 disconnects the key-on operation device 7 and connects the key-off operation device 5 in response to the signal of the wake-up determination device 3. Therefore, the switching output device 9 connects the key-on operation device 7 to operate the pump by key-on output thereof, and connects the key-off operation device 5 to operate the pump by key-off output thereof.

Figure 4:
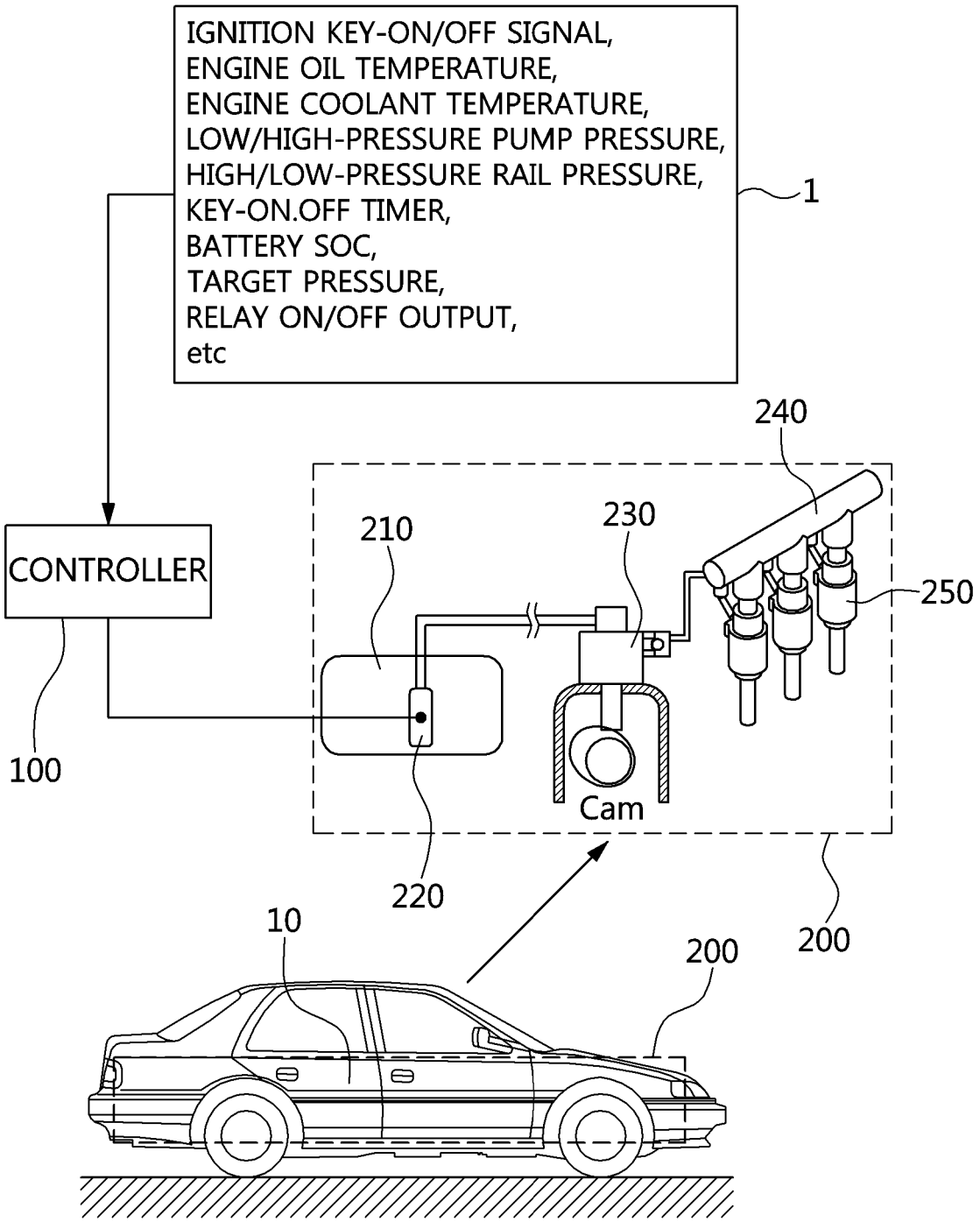
FIG. 4 is a view illustrating an example of a vehicle, a fuel system of which is controlled by the controller according to an exemplary embodiment of the present invention.

FIG. 4 illustrates an example of a vehicle 10 including an ECU 100 and a fuel system 200.

As illustrated in FIG. 4, the ECU 100 is configured to control relay on or off output based on the ignition key-on or off signal, an engine oil temperature, an engine coolant temperature, a low/high-pressure pump pressure, a high/low-pressure rail pressure, a key-on or off timer signal, a battery SOC, a target pressure, etc., which are provided as input data. Therefore, the ECU 100 includes all functions realized by the controller 1 of FIG. 3. The fuel system 200 includes a fuel tank 210, low-pressure and high-pressure fuel pumps 220 and 230 respectively which pump fuel at different fuel pressures, a common rail 240 for supplying fuel, and an injector 250 which injects fuel into an engine combustor. Therefore, the fuel system 200 is identical to a typical fuel system.

Hereinafter, the method of improving engine startability using hardware wake-up period control illustrated in FIG. 1 and FIG. 2 will be described in detail with reference to FIG. 3 to FIG. 6. Here, the controller 1 which is connected to the ECU 100 of the vehicle 10 including all functions thereof is a control subject. The low-pressure fuel pump 220 of the fuel system 200 is a target to be controlled, but the high-pressure fuel pump 230 may be a target to be controlled as necessary.

When an engine key is not turned off in the engine key-off determination step (S10), controller 1 maintains a normal fuel pump operation control mode (S220) by maintaining a key-on timer operation (S210) by engine key-on (S200), and continues to perform the engine key-off determination step (S10). In the normal fuel pump operation control mode, controller 1 connects the switching output device 9 to the key-on operation device 7 to send key-on output in response to the signal of the key-on timer, thereby operating the low-pressure fuel pump 220 by the key-on output, as illustrated in FIG. 3.

On the other hand, when the engine key is turned off in the engine key-off determination step (S10), the process proceeds to a determination condition variable detection step (S20) so that the controller 1 changes the normal fuel pump operation control mode to a wake-up fuel pump operation control mode. The wake-up fuel pump operation control mode is divided into a vehicle state detection mode (S20 and S30), a wake-up fuel pressure control mode (S40 and S50), a pump operation control mode (S60), and a wake-up repetition control mode (S70 to S110).

Figure 5:
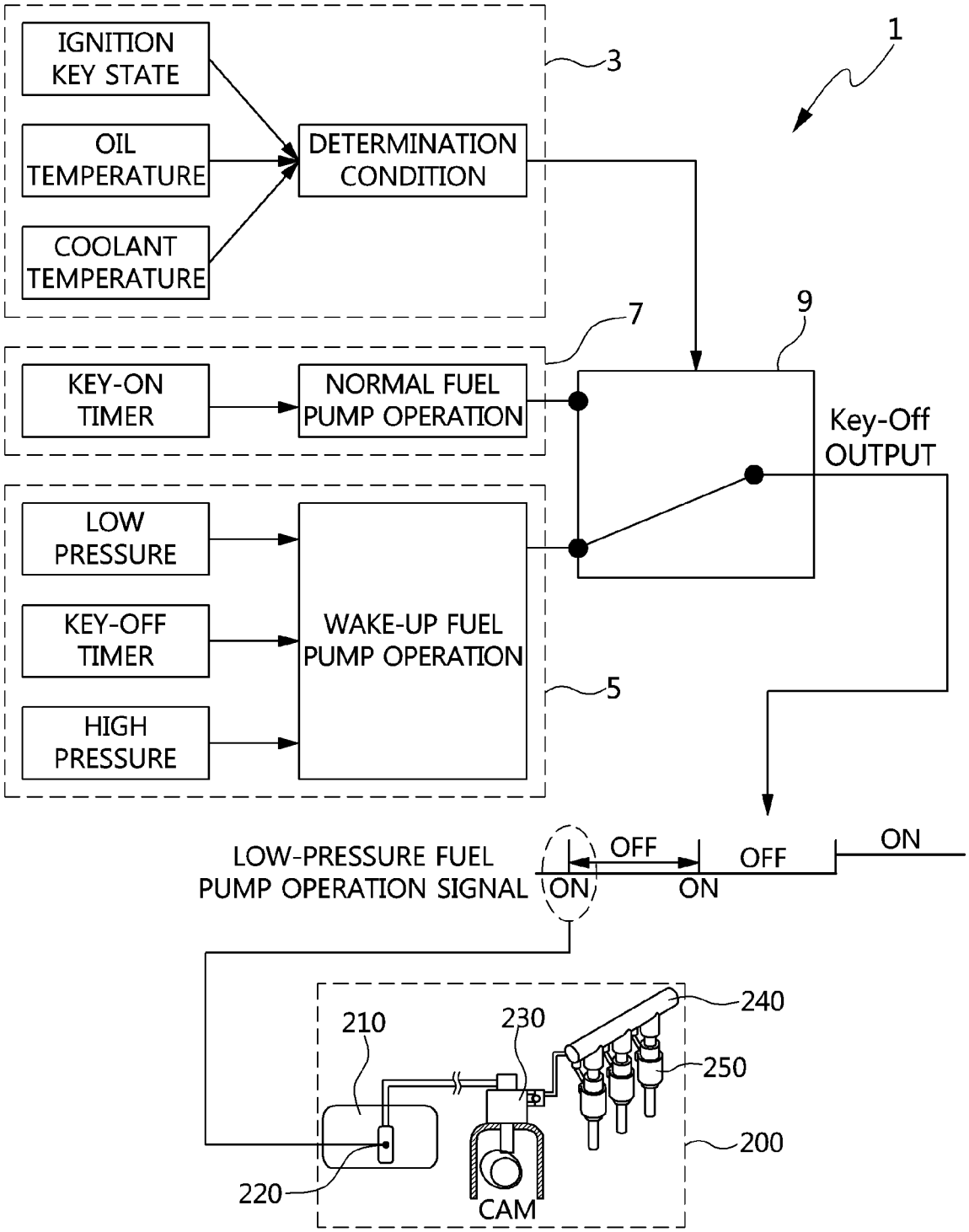
FIG. 5 is a view illustrating an operation state of the controller that controls the fuel system according to an exemplary embodiment of the present invention.

Referring to FIG. 4, the controller 1 is connected to the ECU 100 and provides engine key-off required in the ignition key state of the wake-up determination device 3. Referring to FIG. 5, the wake-up determination device 3 recognizes the engine key-off in the ignition key state and checks the engine key-off for satisfaction of the determination condition.

Controller 1 performs the vehicle state detection mode in a determination condition variable detection step (S20) and a soaking time storage and key-off timer operation step (S30). In the determination condition variable detection step (S20) each value of a battery voltage, an engine coolant temperature, and an engine oil temperature, which are applied as determination condition variables, is read. In the soaking time storage and key-off timer operation step (S30), the soaking time at the moment when the determination condition variables are applied is set as a current soaking time, and the detected soaking time is defined and stored as $ST_{old}$. Therefore, it is stored as detected soaking time=$ST_{old}$. The key-off timer operation means that the key-off timer counts time in minutes together with storage of $ST_{old}$ and the $ST_{old}$ reaches a set time, but does not mean that the switching output device 9 is connected to the key-off operation device 5 to send key-off output therefrom.

Controller 1 performs the wake-up fuel pressure control mode in a wake-up operation condition determination step (S40) and a fuel pressure control condition satisfaction step (S50).

S40 is a step of determining whether or not to satisfy a wake-up operation condition. The wake-up operation condition uses a battery voltage, an engine coolant temperature, and an engine oil temperature, and the values detected in step S20 are respectively applied to the following relationships:

The condition of the battery: battery voltage>a;

The condition of the engine oil: engine oil temperature>b; and

The condition of the engine cooling temperature: engine coolant temperature>c.

Here, "a" is a set battery voltage of approximately 10V, "b" is a set engine oil temperature of approximately 70° C., and "c" is a set engine coolant temperature of approximately 70° C. In addition, the symbol ">" is a sign of inequality indicative of the size relationship between two values, and "A>B" means that A is a larger value than B.

Accordingly, when the battery voltage is not greater than "a", when the battery voltage is greater than "a" and the engine oil temperature is not greater than "b", or when the engine oil temperature is greater than "b" and the engine coolant temperature is not greater than "c", there is no need to perform the wake-up fuel pump operation control mode. Therefore, the time count of the key-off timer is stopped. The count stop of the key-off timer means the stop of logic execution in the wake-up fuel pump operation control mode. On the other hand, when the battery voltage is greater than "a", the engine oil temperature is higher than "b", and the engine coolant temperature is higher than "c", the process proceeds to a fuel pressure control determination mode (S50).

Referring to FIG. 4, controller 1 is connected to the ECU 100 and determines whether to satisfy a battery voltage condition in response to the signal indicative of the battery voltage condition determined by the ECU 100. Referring to FIG. 5, controller 1 determines the engine oil temperature and the engine coolant temperature only when the battery voltage is greater than "a". The present is because the battery is discharged when the battery voltage is less than "a". Therefore, the wake-up determination device 3 outputs a signal when the conditions of the engine oil temperature and the engine coolant temperature are satisfied in the state in which the engine key is turned off and the battery voltage is greater than "a". The switching output device 9 disconnects the key-on operation device 7 and connects the key-off operation device 5 in response to the signal of the wake-up determination device 3 so that it is changed to a key-off output state. However, since the signal of the key-off timer is not in the present state, the key-off output is not sent from the switching output device 9.

S50 is a step of determining whether or not to satisfy a fuel pressure control condition. The fuel pressure control condition uses a soaking time, and is applied to the following relationship:

The satisfaction of the fuel pressure control condition: $ST_{now}>ST_{old}+A$ [time (minute)].

Here, "$ST_{old}$" is a soaking time detected at the time when the engine key-off is determined, "A" is an elapsed time after satisfying the wake-up operation condition, and "$ST_{now}$." is a set soaking time of approximately 80 minutes. In addition, the symbol ">" is a sign of inequality indicative of the size relationship between two values, and "$ST_{now}>ST_{old}+A$ [time (minute)]" means that the soaking time at the present time exceeds a set time of 80 minutes.

Referring to FIG. 5, the key-off operation device 5 generates a key-off timer signal when the set condition of the soaking time ($ST_{now}$) is satisfied, and the operation of the wake-up pump is controlled in response to the generated key-off timer signal. Therefore, the key-off output of the switching output device 9 is sent by performing a wake-up pump operation control step (S60) in the state in which the key-off timer signal is generated.

The controller 1 performs the pump operation control mode in the wake-up pump operation control step (S60).

Referring to FIG. 2, the operation of the wake-up pump is controlled in a wake-up failure diagnosis stop step (S61), a low-pressure rail pressure detection step (S62), a high-pressure pump pressure detection step (S63), a communication initialization step (S64), a target pressure determination and output step (S65), a current supply (main relay) step (S66), a high-pressure rail pressure determination step (S67), and a low-pressure pump operation step (S68).

The wake-up failure diagnosis stop step (S61) is configured to stop a procedure for failure diagnosis of hardware unrelated to wake-up functions. Therefore, only controller 1 and the low-pressure fuel pump 220 are activated when the ECU 100 controls the operation of the wake-up pump, thereby reducing the consumption of the battery voltage. The low-pressure rail pressure detection step (S62) is configured for detecting the pressure of the residual fuel in a low-pressure fuel line (e.g. a common rail) after fuel is supplied thereto. The high-pressure pump pressure detection step (S63) is configured for detecting the pressure applied to a high-pressure pump. The communication initialization step (S64) is a step of checking communication such as Controller Area Network (CAN). Therefore, the ECU 100 checks the communication state of hardware related to the operation control of the low-pressure pump 220 and controller 1. The target pressure determination and output step (S65) is configured for determining and outputting a target pressure of residual fuel that may resolve the extended time required to form low pressure which causes an ignition delay when the low-pressure pump is operated under the conditions of the detected low-pressure rail pressure and high-pressure pump pressure. That is, the target pressure is a pressure for maintaining the residual fuel in a liquid-phase state to prevent the fuel from changing from a liquid phase to gas phase due to the rapid deterioration of the residual fuel pressure in the fuel line. The current supply (main relay) step (S66) is configured to connect the battery.

Referring to FIG. 4, the ECU 100 performs wake-up failure diagnosis stop, low-pressure rail pressure detection, high-pressure pump pressure detection, communication initialization, target pressure determination and output, etc., and the controller 1 is connected to the ECU 100 to recognize the determination information of the ECU 100 in response to the signal transmitted from the ECU 100. In the present case, the controller 1, the low-pressure fuel pump 220, the high-pressure fuel pump 230, the battery, etc. are used for communication initialization. The target pressure output means the output of signals, and the current supply (main relay) means the supply of current to the battery.

Particularly, the high-pressure rail pressure determination step (S67) is configured to detect the residual fuel pressure in a high-pressure fuel line (e.g. a common rail) after fuel is supplied thereto. In the present case, the high-pressure rail pressure is determined by the following relationship:

The determination of high-pressure rail pressure: high-pressure rail pressure<e.

Here, the high-pressure rail pressure is a pressure of the high-pressure rail in the fuel line detected at the present time (i.e. a detected high-pressure rail pressure), and "e" is a set high-pressure rail pressure of 24 bar. However, the pressure of the high-pressure fuel pump 230 detected at the present time may be applied instead of the above high-pressure rail pressure. In addition, the symbol "<" is a sign of inequality indicative of the size relationship between two values, and "high-pressure rail pressure<e" means that the detected high-pressure rail pressure at the present time is a value less than 24 bar.

Therefore, when the high-pressure rail pressure (i.e. the detected high-pressure rail pressure) is greater than 24 bar, there is no need to operate the low-pressure fuel pump 220. Thus, the time count of the key-off timer is stopped and the process proceeds to step S80-1 of FIG. 1. The step (S80-1) will be described infra.

The low-pressure pump operation step (S68) is a step of operating the low-pressure fuel pump 220 when the high-pressure rail pressure (i.e. the detected high-pressure rail pressure) is less than 24 bar.

Referring to FIG. 5, when the ECU 100 determines that the high-pressure rail pressure is 24 bar or less, the key-off operation device 5 outputs a key-off timer signal over time to the switching output device 9, and the switching output device 9 sends key-off output to the low-pressure fuel pump 220. The ECU 100 causes the low-pressure fuel pump 220 to be operated by the power supplied from the battery. In the present case, the switching output device 9 sends the key-off output in the form of pulse for approximately 1 second, with the consequence that the low-pressure fuel pump 220 is operated for approximately 1 second and is then stopped.

As a result, the operation and stop of the low-pressure fuel pump 220 is completed by one cycle of wake-up pump operation control.

Referring to FIG. 1 again, the controller 1 performs the wake-up repetition control mode in a step of counting the number of times wake-up is performed for one cycle of wake-up pump operation control (S70), a step of determining a low-pressure pump pressure (S80), a step of determining whether the count of the key-off timer continues to be performed by the determination of the battery voltage (S90), a step of determining whether interruption is performed according to an attempt at key-off (S100), and a step of determining the number of times the cycle of wake-up pump operation control is repeated (S110).

S70 is a step which counts the wake-up NO as N and storing the same. Here, the wake-up NO is the number of times the low-pressure fuel pump is operated for one cycle of wake-up pump operation control, and "N" is a count number and is increased by 1, 2, 3, . . . , n (n is an integer equal to or greater than 4). Therefore, "wake-up NO=1" means that the low-pressure fuel pump 220 is operated and stopped once by one cycle of wake-up pump operation control.

S80 is a step of determining whether a wake-up stop condition is satisfied by the low-pressure pump pressure. To the present end, the following relationship is applied to the step:

The determination of low-pressure pump pressure: low-pressure pump pressure>f.

Here, the low-pressure pump pressure is a pressure of the low-pressure pump detected at the present time (i.e. a detected low-pressure pump pressure), and "f" is a set low-pressure pump pressure of 1.5 bar. However, the pressure in the fuel line (e.g. the low-pressure rail detected at the present time may be applied instead of the above low-pressure pump pressure. In addition, the symbol ">" is a sign of inequality indicative of the size relationship between two values, and "low-pressure pump pressure>f" means that the detected high-pressure pump pressure at the present time is a larger value than 1.5 bar.

Therefore, when the low-pressure pump pressure (i.e. the detected low-pressure pump pressure) is less than 1.5 bar, there is no need to operate the low-pressure fuel pump 220. Thus, the time count of the key-off timer is stopped and the process proceeds to step S80-1.

Step S80-1 is configured for initializing the first-stored soaking time ($ST_{old}$) in step S30 to a current soaking time. The present step is performed when the high-pressure rail pressure (i.e. the detected high-pressure rail pressure) is greater than 24 bar (S67) and when the low-pressure pump pressure (i.e. the detected low-pressure pump pressure) is less than 1.5 bar (S80). Therefore, the soaking time is stored in the state in which $ST_{now}$ is changed to $ST_{old}$ at the time of the determination of high-pressure rail pressure or at the time of the determination of low-pressure pump pressure in step S80-1, but the soaking time changed from $ST_{now}$ to $ST_{old}$ differs from the soaking time ($ST_{old}$) which is first stored after key-off. The reason is because the soaking time initialization step (S80-1) precedes the fuel pressure control condition satisfaction step (S50) and the relationship $ST_{now}>ST_{old}+A$ [time (minute)] is applied to the determination of fuel pressure control condition satisfaction (S50).

S90 is a step of determining whether the wake-up stop condition is satisfied by the battery voltage. To the present end, the following relationship is applied to the step:

The condition of wake-up stop: battery voltage>g.

Here, the battery voltage is a battery voltage detected at the present time, and "g" is a set battery voltage of 10V. Therefore, the battery voltage of 10V is applied to both of the wake-up stop condition (S90) and the battery condition (S20). In addition, the symbol ">" is a sign of inequality indicative of the size relationship between two values, and "battery voltage>g" means that the detected battery voltage at the present time is a larger value than 10V.

Therefore, when the battery voltage (i.e. the detected battery voltage) is less than 10V, there is no need to operate the low-pressure fuel pump 220. Thus, the count of the key-off timer is stopped, and at the same time the method of improving engine startability using hardware wake-up period control is completed and initialized by the controller 1.

Figure 6:
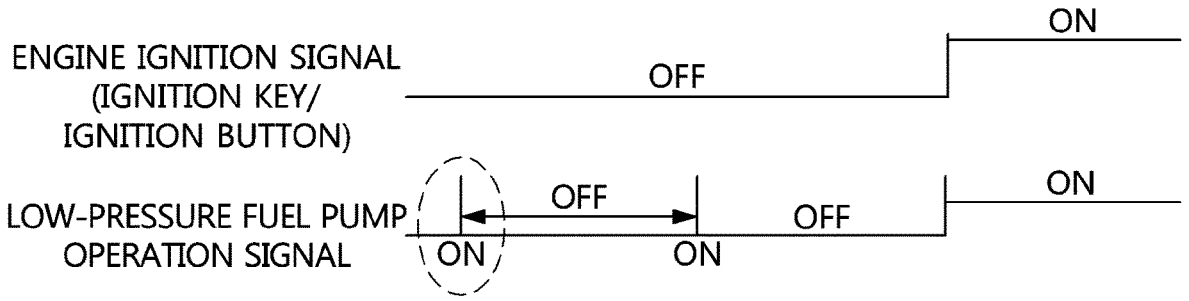
FIG. 6 is a view illustrating an operation state of a low-pressure fuel pump during key-off and key-on according to an exemplary embodiment of the present invention.

S100 is a step of determining an interruption condition according to the wake-up stop. The present is determined by engine key-on. Referring to FIG. 6, when the engine is started by key-on, it can be seen that the controller 1 changes the low-pressure fuel pump operation signal to an ON state using the key-on timer. When the operation signal is changed to the ON state by the key-on timer, the key-on operation device 7 is connected to the switching output device 9 in response to the signal of the key-on timer and the operation of the low-pressure fuel pump 220 is controlled by key-on output. Therefore, when the key-on operation device 7 is activated, the normal fuel pump operation control mode (S220) is performed while the count of the key-off timer is stopped.

S110 is a step of determining the number of times the low-pressure fuel pump is operated in the state in which the key-off is maintained. To the present end, the relationship related to the number of times wake-up is performed is applied to the step:

The number of times wake-up is performed: wake-up NO<B.

Here, "wake-up NO" is the number of times the low-pressure fuel pump is operated, which is counted and stored in step S70, and "B" is the set number of times the low-pressure fuel pump is operated and is 6. In addition, the symbol "<" is a sign of inequality indicative of the size relationship between two values, and "wake-up NO<B" means that the number of times the low-pressure fuel pump is operated at the present time is a value less than 6.

Therefore, when the number of times the low-pressure fuel pump is operated does not exceed 6 times, the process feeds back to step S50 and the fuel pressure control condition satisfaction step is performed. In the present step, when the fuel pressure control condition of $ST_{now}>ST_{old}+A$ [Time (minute)] is satisfied after 80 minutes, the wake-up pump operation control step (S60) is performed. As a result, "N" for determining the wake-up NO is 2, and thus the cycle of wake-up pump operation control is performed twice so that the number of times the low-pressure fuel pump 220 is operated is also 2 times. The present procedure is repeated 6 times until the set value of "B" is 6.

On the other hand, when the number of times the low-pressure fuel pump is operated is 6 times, the count of the key-off timer is stopped and at the same time the method of improving engine startability using hardware wake-up period control is completed and initialized by the controller 1.

As described above, in the vehicle according to an exemplary embodiment of the present invention, the engine startability using hardware wake-up period control is improved by performing the vehicle state detection mode to which the battery voltage, engine oil temperature, and engine coolant temperature are applied by controller 1 in the key-off state of the engine, the wake-up fuel pressure control mode for determining whether the soaking time reaches a wake-up set time by the count of the key-off timer for 80 minutes, the pump operation control mode for operating the low-pressure fuel pump 220 for approximately 1 second by the current supplied in response to the key-off output signal over a period of 80 minutes, and the wake-up repetition control mode for repeating the number of times the low-pressure fuel pump 220 is operated to a maximum of 6 times. Thus, it is possible to prevent the change of fuel from a liquid phase to gas phase due to the rapid deterioration of residual fuel in the fuel system 200 when the engine is driven under a high load and then the ignition key thereof is turned off while resolving restriction due to addition of separate hardware. Particularly, the present invention can also prevent deactivation due to discharge of the battery by applying the State of Charge (SOC) of the battery to a condition of operation of the low-pressure fuel pump 220.

A vehicle according to the exemplary embodiments of the present invention has the following advantages and effects by application of ECU wake-up period control to improve engine startability.

Firstly, there is no need for additional hardware such as an interface or a gateway and an ECU pin in the control of fuel pressure performed after the ignition key of an engine is turned off. Secondly, since the fuel pressure is controlled by operating a low-pressure pump using an ECU, the engine startability is effectively improved. Thirdly, since the wake-up period of the ECU for operating the low-pressure pump is connected to the soaking time of the engine, an ignition delay is improved even after the vehicle is stopped for one day or more. Fourthly, it is possible to prevent bubbles from being generated in residual fuel in a fuel line even though the vehicle travels under a high load and the ignition key thereof is then turned off. Fifthly, the pressure in the fuel line can be uniformly maintained by the control of fuel pressure performed after the ignition key of the engine is turned off. Sixthly, since the low-pressure pump is operated based on the SOC of the battery by the ECU, it is possible to improve engine startability without the discharge of the battery.

For convenience in explanation and accurate definition in the appended claims, the terms "upper", "lower", "internal", "outer", "up", "down", "upwards", "downwards", "front", "rear", "back", "inside", "outside", "inwardly", "outwardly", "internal", "external", "forwards" and backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method of improving engine startability, comprising:

performing a vehicle state detection mode in which a battery voltage detection value, an engine oil temperature detection value, and an engine coolant temperature detection value are read by a controller in a key-off state of an engine, a soaking time is stored, and a count of a key-off timer is initiated;

performing a wake-up fuel pressure control mode in which when each of the battery voltage detection value, the engine oil temperature detection value, and the engine coolant temperature detection value satisfies a set condition, whether the soaking time reaches a wake-up set time is determined by the count of the key-off timer;

performing a pump operation control mode in which key-off output is sent in response to a signal of the key-offtimer when the soaking time reaches the wake-up set time, and after a low-pressure fuel pump is operated by a current supplied thereto for a time at which the key-off output is maintained, the operation of the low-pressure fuel pump is configured to be stopped by cut-off of the key-off output; and performing a wake-up repetition control mode in which a number of times the low-pressure fuel pump is operated is counted as 1, and after the operation and stop of the low-pressure fuel pump are repeated until a number of times the low-pressure fuel pump is operated is counted as 6, the count of the key-off timer is stopped, wherein the performing the pump operation control mode includes detecting a low-pressure rail pressure and a high-pressure rail pressure formed by residual fuel in a fuel line for supplying fuel to the engine after the key-off, determining and outputting a target pressure of the residual fuel under the low-pressure rail pressure and the high-pressure rail pressure, detecting the high-pressure rail pressure formed by the residual fuel and determining whether the detected high-pressure rail pressure value satisfies a set pressure value, and operating the low-pressure fuel pump in response to the signal of the key-off output and stopping the operation of the low-pressure fuel pump by cut-off of the key-off output.

2. The method of claim 1, wherein the count of the key-off timer is performed in minutes, and the wake-up set time is 80 minutes.

3. The method of claim 1, wherein the low-pressure fuel pump is configured to be operated for 1 second.

4. The method of claim 1, wherein the performing the wake-up fuel pressure control mode includes determining whether the battery voltage detection value satisfies a set voltage value as the set condition, determining whether the engine oil temperature detection value satisfies a set oil temperature value as the set condition when the battery voltage detection value satisfies the set voltage value, determining whether the engine coolant temperature detection value satisfies a set coolant temperature value as the set condition when the engine oil temperature detection value satisfies the set oil temperature value, and determining whether the soaking time reaches the wake-up set time.

5. The method of claim 4, wherein the set voltage value is 10V, the set oil temperature value is 70° C., and the set coolant temperature value is 70° C.

6. The method of claim 4, wherein when each of the voltage detection value, the engine oil temperature detection value, and the engine coolant temperature detection value does not satisfy the set condition, the time count of the key-off timer is stopped.

7. The method of claim 1, wherein the target pressure is a pressure for maintaining the residual fuel in a liquid-phase state to prevent the fuel from changing from liquid phase to gas phase.

8. The method of claim 1, wherein the set pressure value is 24 bar.

9. The method of claim 1, wherein when the detected pressure value is greater than the set pressure value, the time count of the key-off timer is stopped.

10. The method of claim 1, wherein the performing the pump operation control mode further includes stopping a procedure for failure diagnosis of hardware unrelated to operation control of the low-pressure fuel pump, initializing communication with hardware related to the operation control of the low-pressure fuel pump, and supplying a battery current to the low-pressure fuel pump.

11. The method of claim 1, wherein the performing the wake-up repetition control mode includes storing a number of times the low-pressure fuel pump is operated as one wake-up NO, determining whether to continuously perform the count of the key-off timer when a low-pressure pump pressure detection value and the battery voltage detection value satisfy a wake-up stop condition, and stopping the count of the key-off timer when the wake-up NO is counted as 6 by the repeated operation and stop of the low-pressure fuel pump.

12. The method of claim 11, wherein the wake-up stop condition is determined by a relationship between the low-pressure pump pressure detection value and a set low-pressure pump pressure value and a relationship between the battery voltage detection value and a set battery voltage value, and the wake-up stop condition is satisfied when the low-pressure pump pressure detection value is greater than the set low-pressure pump pressure value and when the battery voltage detection value is greater than the set battery voltage value.

13. The method of claim 12, wherein the set low-pressure pump pressure value is 1.5 bar, and the set battery voltage value is 10V.

14. The method of claim 12, wherein when the low-pressure pump pressure detection value is less than the set low-pressure pump pressure value, the soaking time is updated and then the count of the key-off timer is initiated again, and when the battery voltage detection value is less than the set battery voltage value, the count of the key-off timer is stopped.

15. The method of claim 11, wherein the performing the wake-up repetition control mode further includes stopping the count of the key-off timer in a key-on state of the engine.

16. A vehicle comprising:

a controller configured to carry out the method of claim 1, the controller comprising a wake-up determination device configured to generate a determination condition satisfaction signal for operating the low-pressure fuel pump based on an ignition key state, an engine oil temperature, and an engine coolant temperature after key-off of the engine, a key-off operation device configured to generate an operation signal for operating the low-pressure fuel pump at a predetermined period when an operation condition of the low-pressure fuel pump occurs, and a switching output device configured to output a key-off output signal to the low-pressure fuel pump for a predetermined time according to the operation signal; and the low-pressure fuel pump operated at a predetermined period and for a predetermined time after the key-off of the engine by control of the controller.

17. The vehicle of claim 16, wherein the predetermined period is 80 minutes.

18. The vehicle of claim 16, wherein the predetermined time is 1 second.

19. The vehicle of claim 16, wherein the low-pressure fuel pump is provided in a fuel tank for storing fuel to pump the fuel, the fuel tank is provided with a high-pressure fuel pump for pumping the fuel, and the fuel tank, the low-pressure fuel pump, and the high-pressure fuel pump form a fuel system together with a common rail for supplying the fuel and an injector for injecting the fuel into an engine combustor.

* * * * *